US009192250B2

(12) United States Patent
Maurer

(10) Patent No.: US 9,192,250 B2
(45) Date of Patent: Nov. 24, 2015

(54) SHELF ASSEMBLY PARTICULARLY SUITABLE FOR WIRE GRID RACK SYSTEMS HAVING RACKS AT FIXED VERTICAL SPACINGS

(71) Applicant: Scott D. Maurer, Asheville, NC (US)

(72) Inventor: Scott D. Maurer, Asheville, NC (US)

( * ) Notice: Subject to any disclaimer, the term of this patent is extended or adjusted under 35 U.S.C. 154(b) by 0 days.

(21) Appl. No.: 13/730,933

(22) Filed: Dec. 29, 2012

(65) Prior Publication Data

US 2015/0102002 A1 Apr. 16, 2015

(51) Int. Cl.

| | |
|---|---|
| ***A47B 43/00*** | (2006.01) |
| ***A47F 5/01*** | (2006.01) |
| ***A47F 5/02*** | (2006.01) |
| ***A47F 5/05*** | (2006.01) |
| ***A47F 5/14*** | (2006.01) |
| ***A47B 47/00*** | (2006.01) |
| *A47B 57/06* | (2006.01) |

(52) U.S. Cl.

CPC ..... *A47F 5/01* (2013.01); *A47B 47/0083* (2013.01); *A47F 5/02* (2013.01); *A47F 5/05* (2013.01); *A47F 5/14* (2013.01); *A47B 57/06* (2013.01)

(58) Field of Classification Search

CPC ..... A47F 5/01; A47F 5/02; A47F 5/05; A47F 5/14; A47B 47/0083; A47B 57/06

USPC ..... 211/187, 188, 190–194, 175, 186; 108/147.11–147.13

See application file for complete search history.

(56) References Cited

U.S. PATENT DOCUMENTS

| | | | | | |
|---|---|---|---|---|---|
| 2,833,421 | A | * | 5/1958 | Skubic | 211/194 |
| 3,322,381 | A | * | 5/1967 | Bubb | 248/121 |
| 4,036,369 | A | | 7/1977 | Eisenberg | |
| 4,128,064 | A | * | 12/1978 | Chung et al. | 108/192 |
| 4,237,798 | A | * | 12/1980 | Welsch et al. | 108/192 |
| 4,318,352 | A | * | 3/1982 | Friedman et al. | 108/107 |
| 4,527,490 | A | * | 7/1985 | Tipton et al. | 108/192 |
| 4,615,278 | A | | 10/1986 | Cabrelli | |
| 4,627,543 | A | * | 12/1986 | Nicely | 211/187 |
| 4,635,563 | A | | 1/1987 | Hand et al. | |

(Continued)

FOREIGN PATENT DOCUMENTS

| | | |
|---|---|---|
| TW | M248307 | 11/1992 |
| TW | M416391 U1 | 11/2011 |

OTHER PUBLICATIONS

PCT/US2013/00279; International Search Report; Filed Dec. 18, 2013; Maurer.

*Primary Examiner* — Joshua J Michener
*Assistant Examiner* — Devin Barnett
(74) *Attorney, Agent, or Firm* — Van Winkle, Buck, Wall, Starnes and Davis, P.A.; David M. Carter

(57) ABSTRACT

A modular wire grid rack system is provided that includes a pair of storage racks, each storage rack having a plurality of intersecting wire rods, and a plurality of posts connected to the storage racks and separating the storage racks. An intermediate storage assembly is locatable between the pair of storage racks and includes a retaining element configured to be seated on one of the posts and a shelf arm, in the installed disposition of the intermediate storage assembly, a load imposed on the shelf arm by a supported object urges the angular ends of the channel engaging protrusion of the retaining element to move toward one another, thereby reinforcing the strength and stability of the seating of the retaining element on the respective post.

1 Claim, 16 Drawing Sheets

(56) References Cited

U.S. PATENT DOCUMENTS

| | | | | | |
|---|---|---|---|---|---|
| 4,656,952 | A | * | 4/1987 | Schweizer | 108/11 |
| 4,750,626 | A | * | 6/1988 | Nicely | 211/187 |
| 4,799,818 | A | * | 1/1989 | Sudimak et al. | 403/107 |
| 4,811,670 | A | | 3/1989 | Kolvites et al. | |
| 4,852,501 | A | * | 8/1989 | Olson et al. | 108/107 |
| 5,183,167 | A | * | 2/1993 | Cheng | 211/187 |
| 5,279,231 | A | * | 1/1994 | Kolvites et al. | 108/107 |
| 5,354,025 | A | * | 10/1994 | McCaffrey | 248/188 |
| 5,601,038 | A | | 2/1997 | Welch et al. | |
| 5,613,449 | A | | 3/1997 | Pullman | |
| 5,644,993 | A | * | 7/1997 | Dohnalik | 108/108 |
| 5,676,263 | A | * | 10/1997 | Chang | 211/187 |
| 5,695,081 | A | * | 12/1997 | Alkalay | 211/187 |
| 5,881,653 | A | * | 3/1999 | Pfister | 108/147.13 |
| 5,884,567 | A | | 3/1999 | Bartz, Jr. | |
| 5,924,581 | A | * | 7/1999 | Chen | 211/187 |
| 5,960,968 | A | * | 10/1999 | Wang | 211/187 |
| 6,015,052 | A | | 1/2000 | Goldberg et al. | |
| 6,036,033 | A | * | 3/2000 | Chang | 211/182 |
| 6,044,988 | A | * | 4/2000 | Yang | 211/187 |
| 6,062,150 | A | * | 5/2000 | Sikora et al. | 108/190 |
| 6,065,407 | A | * | 5/2000 | Wang | 108/147.13 |
| 6,068,143 | A | * | 5/2000 | Wang | 211/187 |
| 6,079,575 | A | * | 6/2000 | Wang | 211/187 |
| 6,123,206 | A | | 9/2000 | Zaremba | |
| 6,253,933 | B1 | * | 7/2001 | Yang | 211/187 |
| 6,257,426 | B1 | * | 7/2001 | Masunaka et al. | 211/187 |
| 6,302,284 | B1 | * | 10/2001 | Zonshin | 211/187 |
| 6,318,572 | B1 | * | 11/2001 | Lai | 211/196 |
| 6,357,611 | B1 | * | 3/2002 | Chen | 211/187 |
| D455,585 | S | | 4/2002 | West | |
| 6,364,138 | B1 | * | 4/2002 | Chen | 211/187 |
| 6,364,139 | B1 | * | 4/2002 | Chen | 211/187 |
| 6,550,730 | B1 | * | 4/2003 | Hong | 248/219.4 |
| 6,659,410 | B1 | * | 12/2003 | Lu | 248/188 |
| 6,695,156 | B1 | * | 2/2004 | Wang | 211/187 |
| 7,100,781 | B2 | * | 9/2006 | Craft | 211/187 |
| 7,478,971 | B2 | * | 1/2009 | Li | 403/398 |
| 7,543,540 | B2 | * | 6/2009 | Tatematsu | 108/192 |
| 7,992,730 | B2 | * | 8/2011 | Huang | 211/187 |
| 8,256,629 | B2 | | 9/2012 | Zhu et al. | |
| 8,333,160 | B2 | * | 12/2012 | Lin | 108/147.13 |
| 8,376,156 | B2 | * | 2/2013 | Jarvis et al. | 211/187 |
| 8,376,157 | B2 | * | 2/2013 | Jarvis et al. | 211/187 |
| 8,678,207 | B2 | * | 3/2014 | Shimazaki et al. | 211/187 |
| 2002/0046982 | A1 | * | 4/2002 | Guizzardi | 211/187 |
| 2002/0113180 | A1 | * | 8/2002 | Wiebe | 248/188 |
| 2003/0131767 | A1 | * | 7/2003 | Chen | 108/147.13 |
| 2004/0065633 | A1 | * | 4/2004 | Chen | 211/187 |
| 2005/0139562 | A1 | * | 6/2005 | Chen | 211/187 |
| 2006/0283824 | A1 | * | 12/2006 | Farley | 211/188 |
| 2007/0095773 | A1 | * | 5/2007 | Schwerman | 211/187 |
| 2007/0256613 | A1 | * | 11/2007 | Lim | 108/147.12 |
| 2008/0092787 | A1 | * | 4/2008 | McAllister et al. | 108/147.12 |
| 2010/0089852 | A1 | * | 4/2010 | Wang | 211/153 |
| 2010/0096352 | A1 | * | 4/2010 | Wang | 211/187 |
| 2010/0108631 | A1 | * | 5/2010 | McAllister et al. | 211/187 |
| 2010/0155352 | A1 | * | 6/2010 | Hsieh | 211/134 |
| 2011/0036278 | A1 | * | 2/2011 | Karl et al. | 108/147.13 |
| 2014/0261107 | A1 | * | 9/2014 | Sabounjian | 108/147.13 |
| 2015/0060380 | A1 | * | 3/2015 | Maurer | 211/90.03 |
| 2015/0060621 | A1 | * | 3/2015 | Sabounjian | 248/243 |

* cited by examiner

SHELF ASSEMBLY PARTICULARLY SUITABLE FOR WIRE GRID RACK SYSTEMS HAVING RACKS AT FIXED VERTICAL SPACINGS

BACKGROUND OF THE INVENTION

Wire grid rack systems are a type of storage arrangement that includes a number of vertical posts collectively supporting wire grid racks. One type of configuration of wire grid rack systems involves modular "knock-down" storage arrangements and these have seen extensive use in both retail and residential environments. Such modular "knock-down" storage arrangements are typically comprised of generally four-sided shelves made up of intersecting wire rods, with each shelf separated and supported by a post at each corner above and below the respective shelf. The user assembles the shelving system by engaging a set of four posts to each of the four corners of a shelf, placing a second shelf on top of the posts, engaging another set of posts to the second shelf, and so on until the shelving system has the desired number of shelves. The shelving system can be disassembled (i.e., "knocked down") merely by disengaging the posts from the shelves, and the posts and shelves can then be stored in a compact manner (e.g., in a box) for storage or transportation.

These modular "knock-down" storage arrangements have become popular because they are typically easy to assemble into an initial storage configuration. However, it is desirable that users can re-configure such modular "knock-down" storage arrangements to more suitably store a different mix of items at a later time after the initial set up. Additionally, it is desirable that users can more fully utilize the available space occupied by the storage arrangement via, for example, providing opportunities to store items in unoccupied areas within the confines or "footprint" of the storage arrangement.

One drawback in re-configuring modular "knock-down" storage arrangements from their initial storage configuration to another configuration is that it is often necessary to at least partially disassemble the storage arrangement and this can involve substantial effort and/or careful use of tools, U.S. Pat. No. 6,364,139 to Chen notes that some conventionally known sectional racks of this type require fastening tools to erect or disassemble the racks. However, according to U.S. Pat. No. 5,364,139 to Chen, improvements have been made to such sectional racks and fastening means and tools are no longer needed in the erection and disassembling thereof. Reference is had to FIG. 1 which is an enlarged exploded perspective view of a portion of a prior art wire grid rack system that, according to U.S. Pat. No. 6,364,139 to Chen, includes vertical posts 10 having a plurality of horizontally spaced annular grooves 13 provided on their outer surfaces, and shelves 12 connected to the vertical posts 10 through two-part connecting members 11. The two parts of the connecting member 11 may be opened or closed relative to each other. A radially inward projected rib 14 is annularly provided along an inner surface of the connecting member 11 at the proper position, such that, when the two parts of the connecting member 11 are in a closed position, it may be put around the vertical post 10 at a predetermined position by engaging the rib 14 with one of the grooves 13. The connecting member 11 in the closed position has a downward and outward inclined outer surface, making it look like a truncated cone. The shelf 12 has short sleeves 15 provided at four corners thereof (only one corner is shown in FIG. 1). Each sleeve 15 has a downward and outward inclined inner surface corresponding to the inclined outer surface of the connecting member 11. The sleeves 15 are separately put around the connecting members 11 mounted on the vertical posts 10 to, on the one hand, force the connecting members 11 toward the vertical posts 10 and, on the other hand, connect the shelves 12 to the vertical posts 10. In the above-described sectional rack, each shelf 12 is connected to the vertical posts 10 by putting four sleeves 15 thereof around four connecting members 11 mounted on the posts 10. If it is intended to increase or decrease the number of shelves 12 of the rack, it is necessary to temporarily remove the top shelf 12 from the rack before other layers of shelves 12 could be adjusted. According to U.S. Pat. No. 6,564,139 to Chen, it is inconvenient for the user to temporarily remove the top shelf 12 from the rack before other layers of shelves 12 are adjusted.

Thus, storage arrangements have been proposed that ease the transition from their initial storage configuration to another configuration. Still more flexibility has been sought, however, so that the variety of items that can be stored, and the accessibility of such stored items, can be increased. To this end, U.S. Pat. No. 7,325,697 to Lim et al notes that storage bins can be used to hold articles and objects, with the storage bins placed on the shelves of a modular "knock-down" storage arrangement in an organized manner. However, according to U.S. Pat. No. 7,325,697 to Lim et al, the use of conventional storage bins has certain disadvantages including, for example, the disadvantage that conventional storage bins are not secured to the shelves, so that a storage bin might slide about the shelf on which it is supported, especially if it is advertently pushed or tipped by a user or another object. This pushed or tipped storage bin may fall off a shelf, causing damage to the contents and possible injury to a person. U.S. Pat. No. 7,325,697 to Lim et al discloses a storage bin that can be engaged to the shelves of a modular "knock-down" storage arrangement in a manner which allows for safe and convenient access to the contents stored in the storage bin.

Despite the continued improvements to the above-described storage arrangements, a need exists for a shelf assembly that can be easily assembled and that can be easily installed at different heights without the need for any tools.

SUMMARY OF THE INVENTION

The present invention solves the above-mentioned problems by providing a shelf assembly for conveniently storing items on a storage arrangement such as, for example, a wire rack grid system.

It is one object of the present invention to provide a new and improved shelf assembly for conveniently storing items on a storage arrangement which may be easily and efficiently manufactured.

It is a further object of the present invention to provide a new and improved shelf assembly for conveniently storing items on a storage arrangement which permits the items to be readily stored at convenient access locations such as, for example, at or generally near the eye level of a user.

It is an additional object of the present invention is to provide a new and improved shelf assembly that permits stored items while still retained by the shelf assembly, to be temporarily re-positioned to another location on a storage arrangement so that a user can readily view, and readily have access to, the stored items.

The present invention provides a fixed location assembly whereby an item can be supported at a desired fixed location on a support post. The supported items can be any desired item such as, for example, a shelf, a pivoting shelf door, or a support hook. One configuration of the fixed location assembly of the present invention is a shelf assembly that advantageously provides a structure for conveniently storing items on a storage arrangement such as, for example, a wire rack grid system.

According to one aspect of the present invention, there is provided a shelf assembly disposable on a support post, the support post being of the type having an outer surface and a plurality of channels located at spacings along the outer surface. The shelf assembly includes a shelf arm and a first retaining element, the first retaining element having a pole axis and including a channel engaging protrusion, the channel engaging protrusion having a radial extent extending perpendicularly to the pole axis and being compatibly configured with respect to a channel of the support post such that the channel engaging protrusion extends radially inward into a respective channel of the support post in an installed disposition of the shelf assembly. The shelf assembly also includes a first gap sleeve, the first gap sleeve being connected to the channel engaging protrusion, and the channel engaging protrusion has a first angular end, a second angular end, and an angular body portion between the first and second angular ends, whereupon the angular body portion of the channel engaging protrusion delimits a partial circumference angular perimeter and the first and second angular ends of the channel engaging protrusion delimiting an angular gap. In further connection with the shelf assembly, the first gap sleeve has a first angular end, a second angular end and an angular body portion between the first and second angular ends, whereupon the angular body portion of the first gap sleeve delimits a partial circumference angular perimeter and the first and second angular ends of the first gap sleeve delimit an angular gap. The angular gaps of the channel engaging protrusion and the first gap-sleeve are at least partially angularly co-incident with one another and the shelf arm and the first retaining element are securable to one another in an assembled condition of the shelf assembly. The shelf arm is configured to provide a selected one of a shelf surface on which an object can be placed that is to be supported by the shelf assembly or a structure to be associated with a shelf surface on which an object can be placed that is to be supported by the shelf assembly. The shelf arm is securable to the first retaining element in the installed disposition of the shelf assembly and the shelf arm and the first retaining element are operatively associated with one another in the installed disposition of the shelf assembly such that a load imposed on the shelf arm by a supported object urges the angular ends of the channel engaging protrusion of the first retaining element to move toward one another.

According to one feature of the one aspect of the present invention, the shelf assembly also includes a second retaining element.

The shelf assembly of the present invention advantageously provides a structure for conveniently storing items on a storage arrangement such as for example, a wire rack grid system. The shelf assembly of the present invention permits convenient storage of items in that, for example, the shelf assembly of the present invention permits items to be readily stored at convenient access locations such as, for example, at or generally near the eye level of a user. Also, the shelf assembly of the present invention can be configured to permit the stored items, while still retained by the shelf assembly, to be temporarily re-positioned to another location on a storage arrangement so that a user can readily view, and readily have access to, the stored items. For example, the shelf assembly of the present invention can be configured as a swing out drawer that can be pivotally mounted on a vertical post of a storage arrangement, whereupon the swing out drawer can be pivoted to an item display position at which the stored items, while still being retained by the swing out drawer, can be readily viewed and accessed by a user. Moreover, many versions of the shelf assembly of the present invention can be easily installed on a storage arrangement such as, for example, a wire rack grid system, without the need for tools. Additionally, with particularly reference to installing the shelf assembly of the present invention on a wire rack grid system, there will often be no need to disassemble or remove any of the already-installed wire grid racks in order to install the shelf assembly of the present invention on a support post.

BRIEF DESCRIPTION OF THE DRAWINGS

Other features and advantages of the invention will become apparent to those skilled in the art upon review of the following detailed description, claims, and drawings.

DETAILED DESCRIPTION OF AN EMBODIMENT

Figure 1:
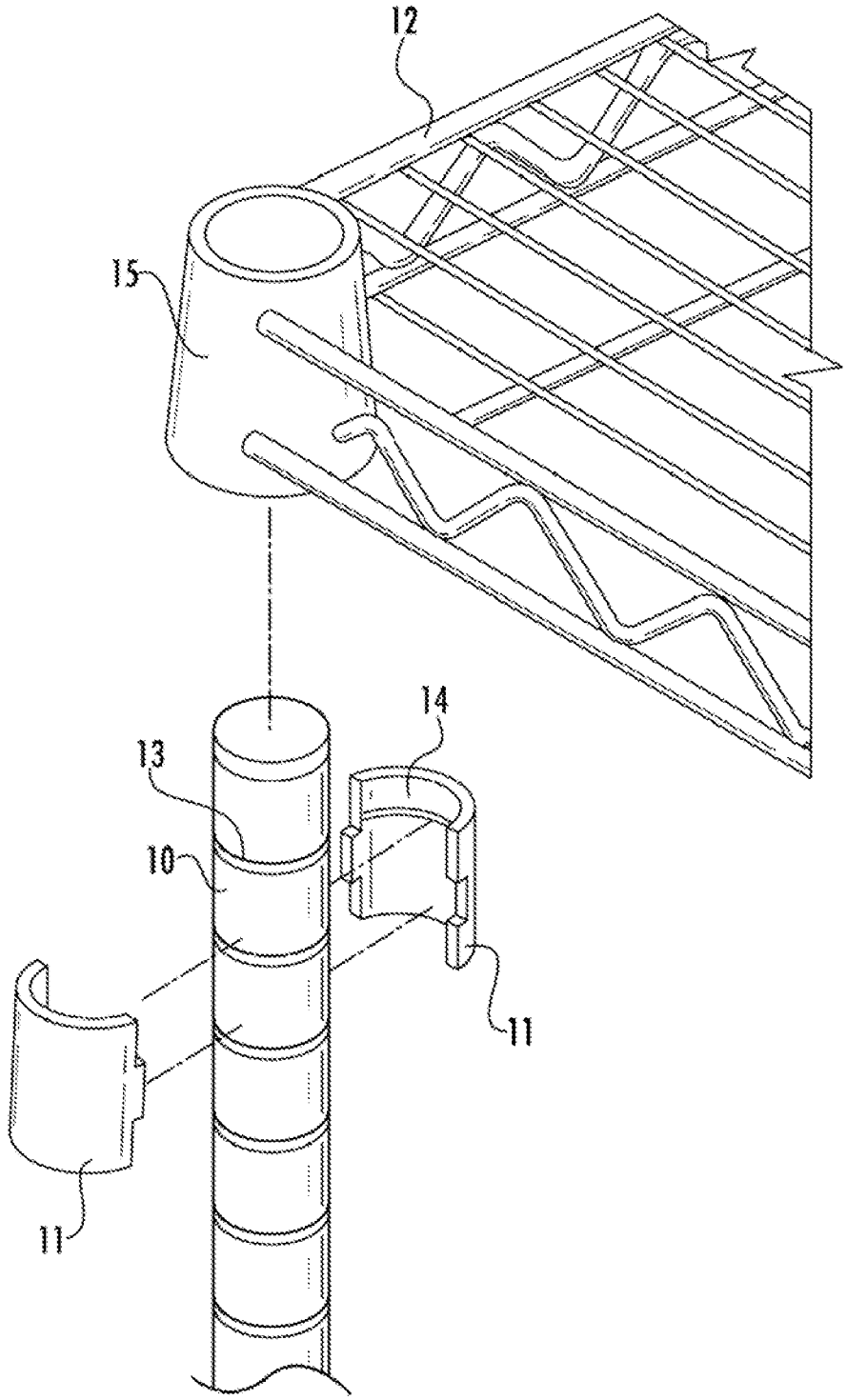
FIG. 1 (PRIOR ART)
FIG. 1 is a perspective view of a prior art wire grid rack system.
Figure 2:
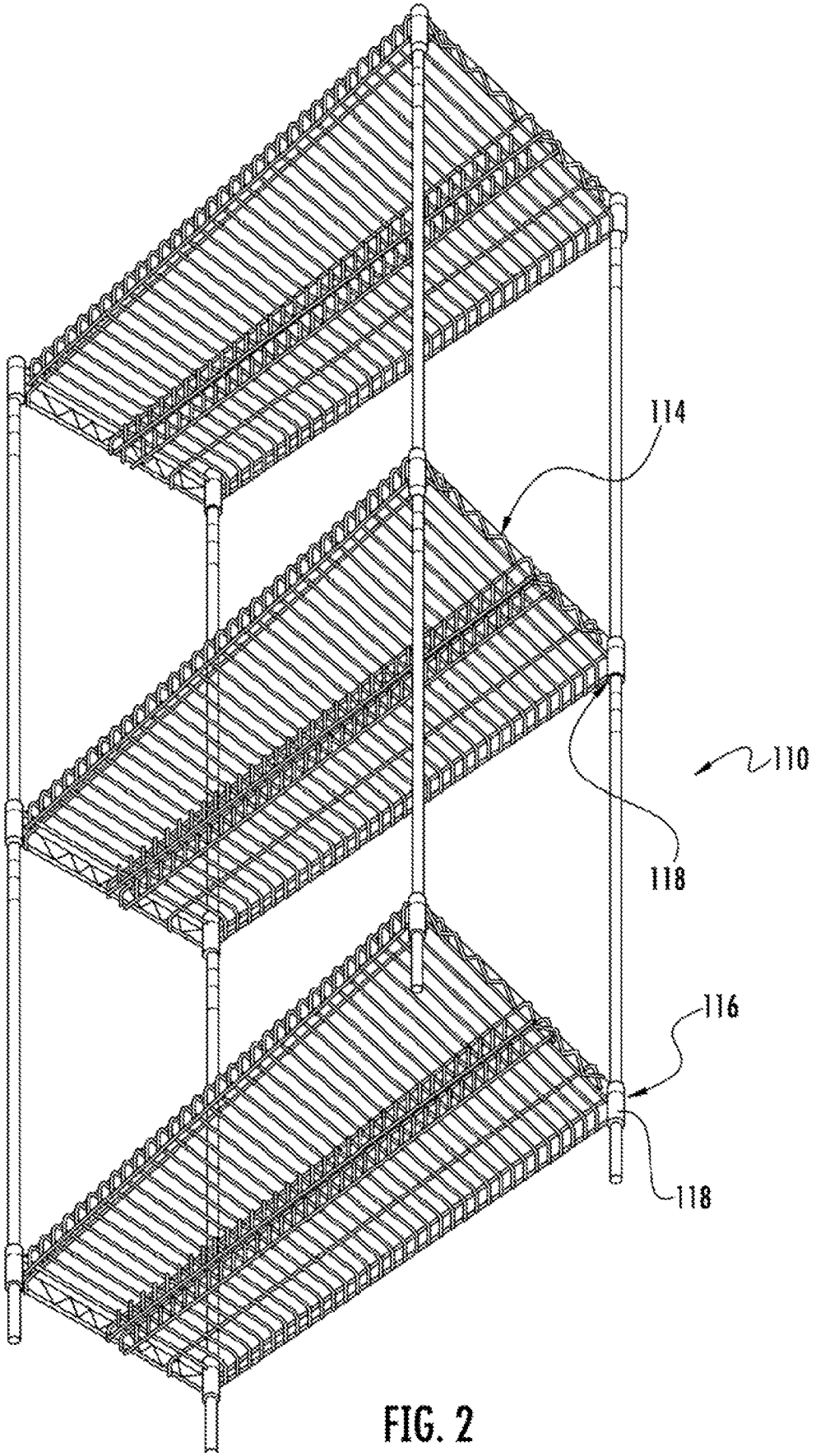
FIG. 2 is a perspective view of a rack system having the shelf assembly of the present invention.
Figure 3:
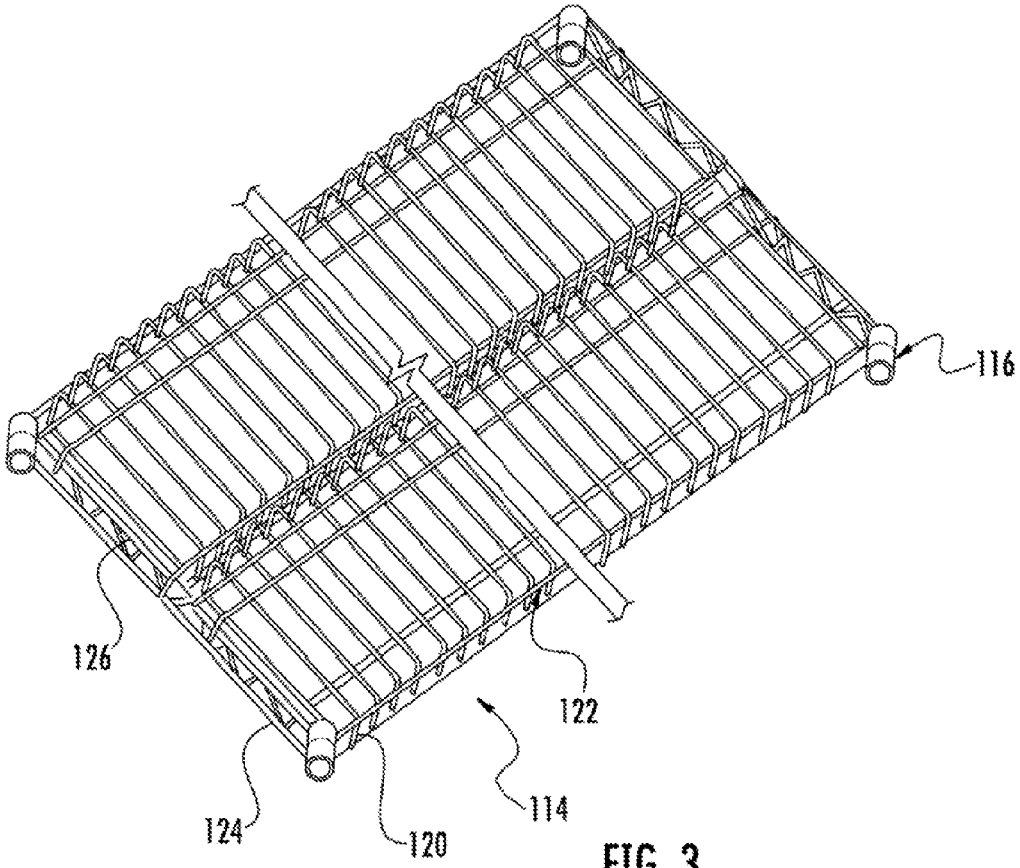
FIG. 3 is a perspective view of an individual rack of the rack system shown in FIG. 2.

The present invention provides a fixed location assembly whereby an item can be supported at a desired fixed location on a support post. The supported items can be any desired item such as, for example, a shelf, a pivoting shelf door, or a support hook. One configuration of the fixed location assembly of the present invention is a shelf assembly that advantageously provides a structure for conveniently storing items on a storage arrangement such as for example, a wire rack grid system. As seen in FIG. 2, which is a perspective view of a wire grid rack rack system having the shelf assembly of the present invention installed thereon, a rack 110 has a plurality of vertical posts—specifically, a total of four (4) posts 112—and a plurality of racks 114 connected to the posts 112. Each rack 114 includes a corner assembly 116 secured to the rack via, for example, welds 118. As seen in FIG. 3, which is a perspective view of an individual rack 114, each of the racks 114 is formed with an open wire grid delimited by two parallel wires 120 and 122 in the front and a pair of side wires 124 and 126. Each of the wires 120, 122, 124 and 126 are welded as indicated to a respective corner support member 128 comprised in a respective corner assembly 116. Each corner assembly 116 also includes an insert member 130 integrally molded from a suitable material, such as, for example, nylon, or another hard, moldable plastic material. Each post 112 has a plurality of radially inwardly extending grooves 134 disposed at uniform axial spacings from one another.

Figure 4:
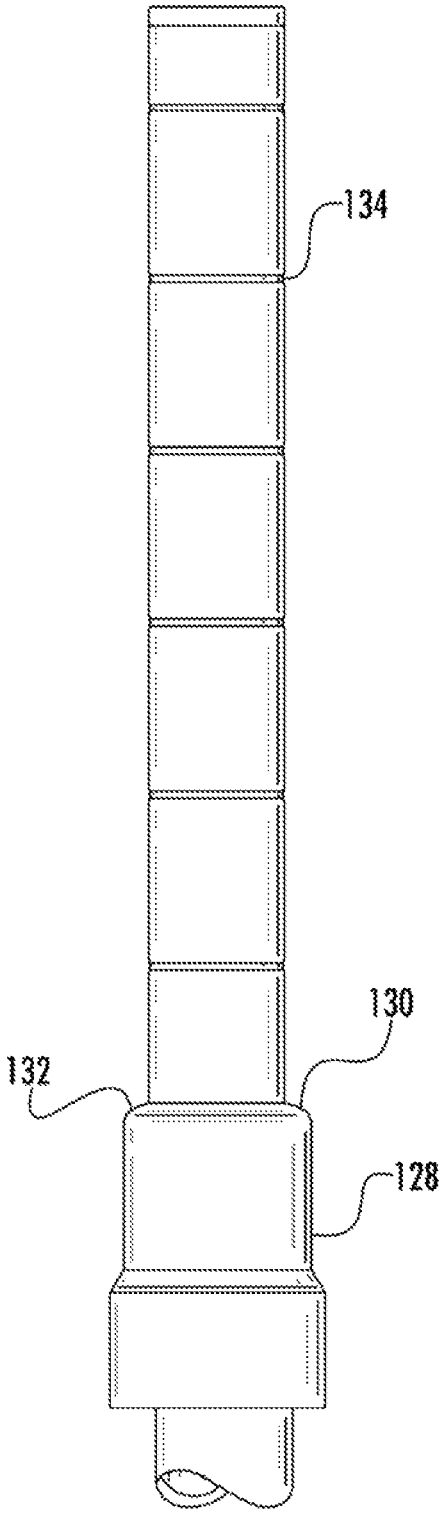
FIG. 4 is an enlarged front elevational view of a post and the respective corner assembly of the rack system shown in FIG. 2.
Figure 5:
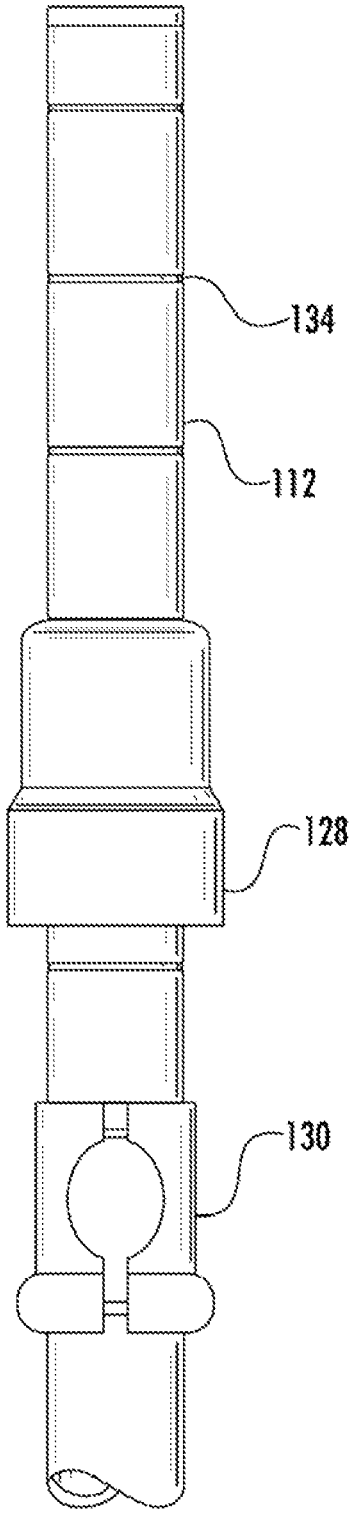
FIG. 5 is an enlarged front elevational view of the post and the respective corner assembly shown in FIG. 4 and showing a corner support member as raised vertically along the post so that an insert member is shown fully exposed in its position on the post.

As seen in FIG. 4, which is an enlarged front elevational view of a post 112 and the respective corner assembly 116, in an assembled condition of a corner support member 128 and an insert 130 member, the corner support member 128 is fully seated over the insert member 130. The insert member 130 has a rib (not shown) formed along its inside circumference that is compatibly configured with respect to the grooves 134 of the posts 112 such that the rib of the insert member 130 seats in a respective groove 134 of the post 112 in the assembled condition of the corner support member and the insert member 130. As seen in FIG. 5 which is an enlarged front elevational view of a post 112 and the respective corner assembly 116, the corner support member 128 is shown as raised vertically along the post 112 so that the insert member 130 is shown fully exposed in its position on that post. It should be noted in the assembled condition in FIG. 4, a portion of insert 130 extends above a top edge 132 of the corner support member 128 so that the area between the post and the corner support member 128 is effectively sealed and so that the insert can be firmly and positively engaged by the upper end of corner support member 128.

The shelf assembly of the present invention advantageously provides a structure for conveniently storing items on a storage arrangement such as, for example, a wire rack grid system. The shelf assembly of the present invention permits convenient storage of items in that, for example, the shelf assembly of the present invention permits items to be readily stored at convenient access locations such as, for example, at or generally near the eye level of a user. Also, the shelf assembly of the present invention can be configured to permit the stored items, while still retained by the shelf assembly, to be temporarily re-positioned to another location on a storage arrangement so that a user can readily view, and readily have access to, the stored items. For example, the shelf assembly of the present invention can be configured as a swing out drawer that can be pivotally mounted on a vertical post of a storage arrangement, whereupon the swing out drawer can be pivoted to an item display position at which the stored items, while still being retained by the swing out drawer, can be readily viewed and accessed by a user. Moreover, many versions of the shelf assembly of the present invention can be easily installed on a storage arrangement such as, for example, a wire rack grid system, without the need for tools. Additionally, with particularly reference to installing the shelf assembly of the present invention on a wire rack grid system, there will often be no heed to disassemble or remove any of the already-installed wire grid racks in order to install the shelf assembly of the present invention on a support post.

Figure 6:
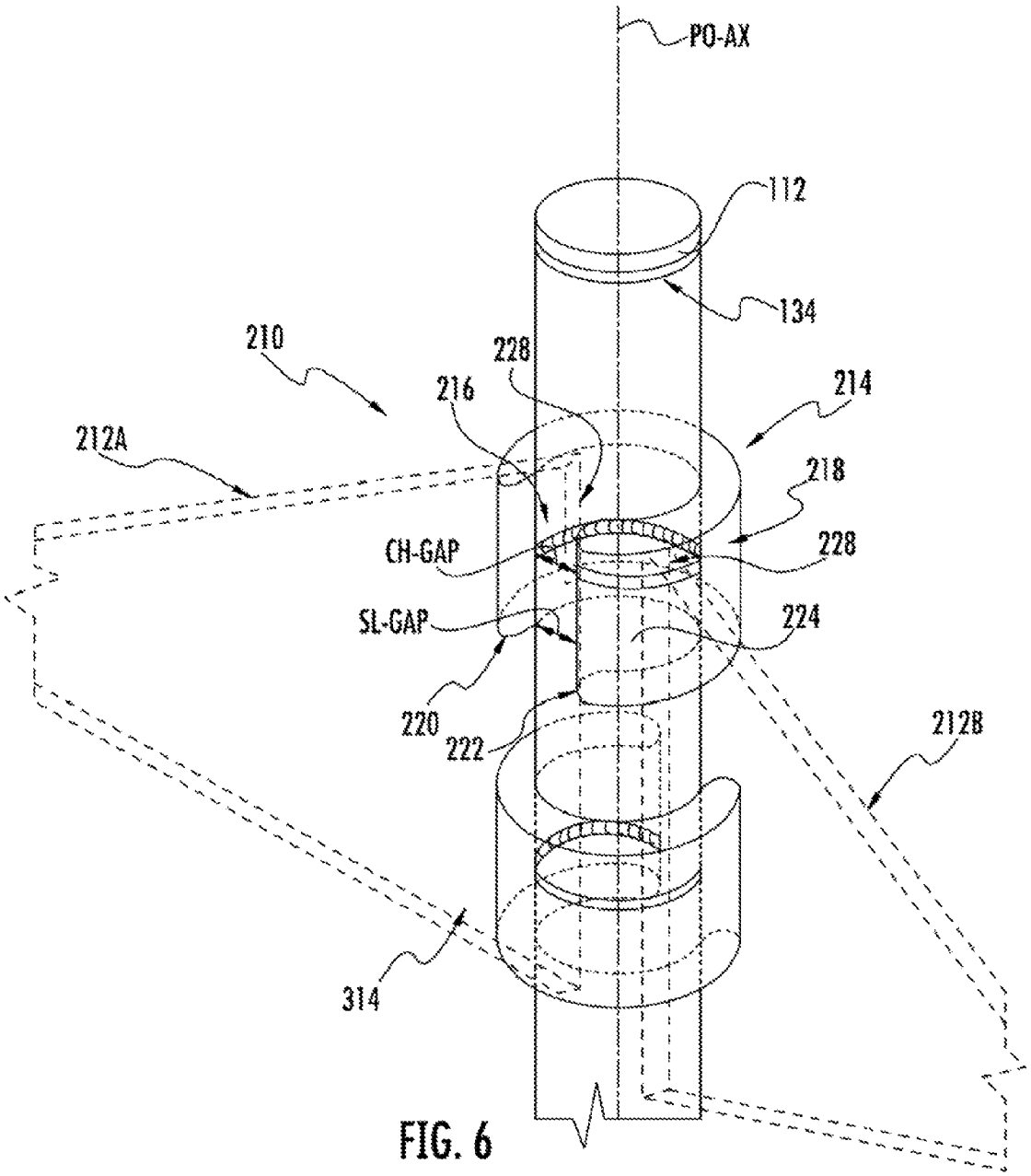
FIG. 6 is an enlarged front elevational view of the shelf assembly of the present invention.

An exemplary version of the shelf assembly of the present invention will now be described and, solely for the purpose of illustration, this exemplary version of the shelf assembly of the present invention will be described with respect to a representative wire rack grid system, it being understood that the shelf assembly of the present invention is also equally suitable for installation on another type of storage arrangement. As seen in FIG. 6, which is an enlarged front elevational view of the shelf assembly of the present invention, the shelf assembly is generally designated as a shelf assembly 210 and the shelf assembly 210 is disposable on a support post. The support post is of the type having an outer surface and a plurality of channels located at spacings along the outer surface. In this connection, the shelf assembly 210 is operable to support a shelved object on a post 112 of the shelf rack 110, as the posts 112 of the shelf rack 110 are of the type having an outer surface and a plurality of channels located at spacings along the outer surface (i.e., the grooves 134). The shelf assembly 210 includes a pair of shelf arms 212A, 212B and a retaining element 214. The retaining element 214 has a pole axis PO-AX and includes a first channel engaging protrusion 216, the first channel engaging protrusion 216 having a radial extent extending perpendicularly to the pole axis PO-AX and being compatibly configured with respect to a channel of the support post (e.g., a groove 134 of a post 112) such that the first channel engaging protrusion 216 extends radially inward into a respective channel of the support post in an installed disposition of the shelf assembly 210. The shelf assembly 210 also includes a gap sleeve 218, the gap sleeve 218 being connected to the first channel engaging protrusion 216. In connection with the description of the shelf assembly herein, the terms "axial", "axially", "radial", "radially", "angular" and "angularly" shall be understood to have reference to, respectively, a longitudinal axis of a support post or the pole axis PO-AX of a gap sleeve of the shelf assembly, in accordance with the context in which the term appears.

The first channel engaging protrusion 216 has a first angular end, a second angular end, and an angular body portion between the first and second angular ends, whereupon the angular body portion of the first channel engaging protrusion 216 delimits a partial circumference angular perimeter and the first and second angular ends of the first channel engaging protrusion 216 delimiting an angular gap CH-GAP.

The gap sleeve 218 has a first angular end 220, a second angular end 222, and an angular body portion 224 between the first and second angular ends, whereupon the angular body portion 224 of the gap sleeve 218 delimits a partial circumference angular perimeter and the first and second angular ends 220, 222 of the gap sleeve 218 delimits an angular gap SL-GAP. The angular gap CH-GAP of the first channel engaging protrusion 216 and the angular gap SL-GAP of the gap sleeve 218 are at least partially angularly co-incident with one another. The gap sleeve 218 is connected to the first channel engaging protrusion 216 in an assembled condition of the shelf assembly 210 and any manner of connection is suitable to the extent that the gap sleeve 218 and the first channel engaging protrusion 216 are so connected that selected forces applied to the gap sleeve 218 enhance the stability and retention strength of the first channel engaging protrusion 216 with respect to a support post 112, as will be described in more detail herein. For example, the gap sleeve 218 and the first channel engaging protrusion 216 can be integrally formed as a single unit via any suitable forming process such as, for example, casting, extrusion, molding, or stamping, and can be integrally formed of any suitable material such as, for example, a metal, alloy, plastic, or polymer material.

Each of the shelf arms 212A, 212B is securable to the retaining element 214 in the assembled condition of the shelf assembly 210. The pair of shelf arms 212A, 212B together form a shelf on which an object can be placed that is to be supported by the shelf assembly. Each of the shelf arms 212A, 212B is securable to the retaining element 214 in the installed disposition of the shelf assembly 210 such that a load imposed on the shelf arms 212A, 212B by a thereon supported object urges the angular ends of the first channel engaging protrusion 216 to move toward one another, in the assembled condition of the shelf assembly 210, the shelf arms 212A is secured to the gap sleeve 218 at an attachment location 226 and the shelf arm 212B is secured to the gap sleeve 218 at an attachment location 228.

The shelf assembly 210 may optionally include a second retaining element 314. The retaining element 314 has a pole axis PO-AX and includes a channel engaging protrusion 316, the channel engaging protrusion 316 having a radial extent extending perpendicularly to the pole axis PO-AX and being compatibly configured with respect to a channel of the support post (e.g. a groove 134 of a post 112) such that the channel engaging protrusion 316 extends radially inward into a respective channel of the support post in an installed disposition of the shelf assembly 310. The shelf assembly 310 also includes a gap sleeve 318, the gap sleeve 318 being connected to the channel engaging protrusion 316.

The channel engaging protrusion 316 has a first angular end, a second angular end and an angular body portion between the first and second angular ends, whereupon the angular body portion of the channel engaging protrusion 316 delimits a partial circumference angular perimeter and the first and second angular ends of the channel engaging protrusion 316 delimiting an angular gap CH-GAP.

The gap sleeve 318 has a first angular end 320, a second angular end 322, and an angular body portion 324 between the first and second angular ends, whereupon the angular body portion 324 of the gap sleeve 316 delimits a partial circumference angular perimeter and the first and second angular ends 320, 322 of the of the gap sleeve 318 delimits an angular gap SL-GAP. The angular gap CH-GAP of the channel engaging protrusion 316 and the angular gap SL-GAP of the gap sleeve 318 are at least partially angularly co-incident with one another.

The shelf arms 312A, 312B and the retaining element 314 are securable to one another in an assembled condition of the shelf assembly 310. Each, of the shelf arms 312A. 312B is securable to the retaining element 314 in the installed disposition of the shelf assembly 310 such that a load imposed on the shelf arms 312A, 312B by a thereon supported object urges the angular ends of the channel engaging protrusion 316 of the second retaining element 314 to move toward one another.

Figure 7:
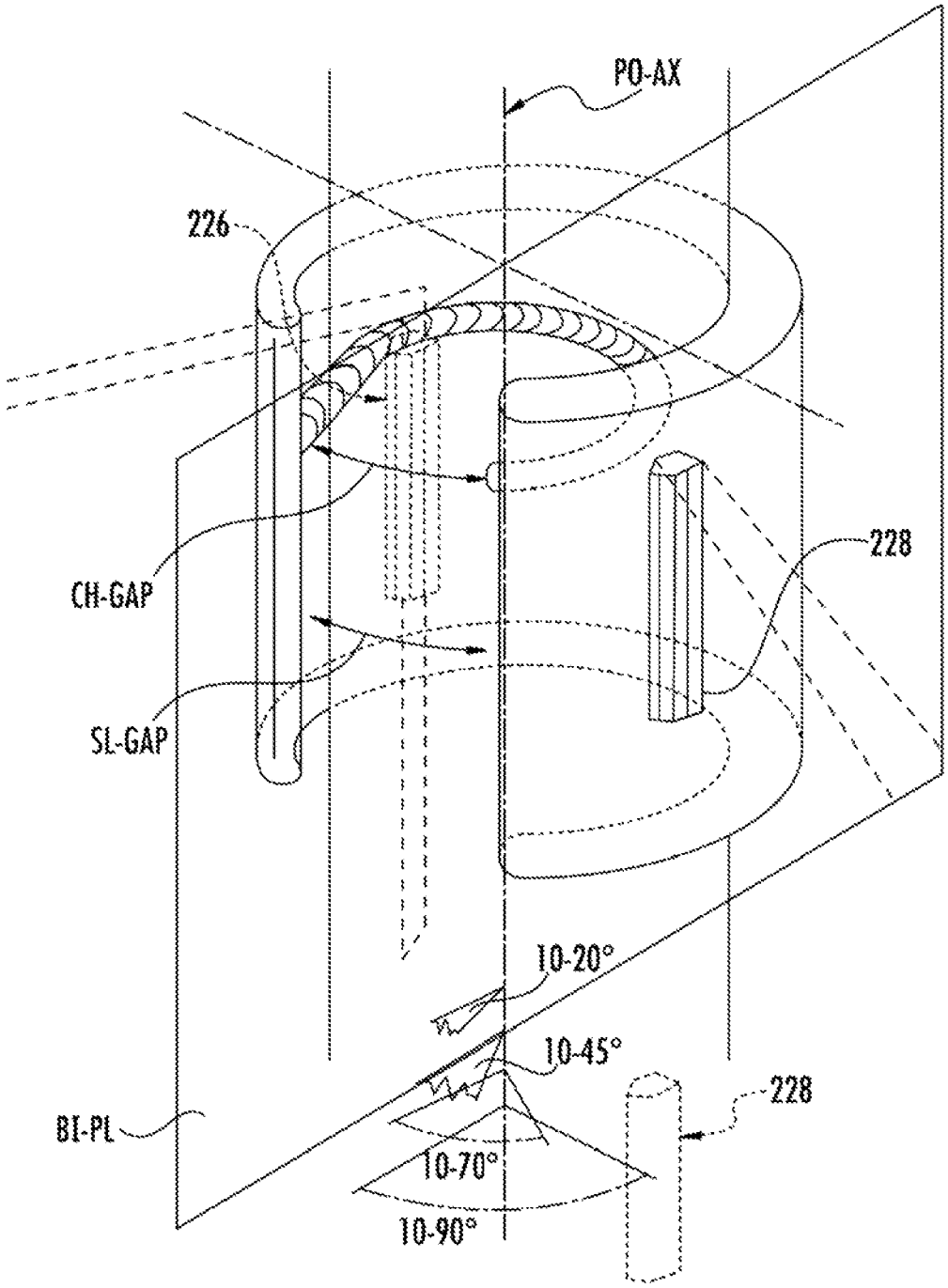
FIG. 7 is an enlarged perspective view of the gap sleeve shown in FIG. 6.

As seen in FIG. 7, which is an enlarged perspective view of the gap sleeve shown in FIG. 6, the angular gap SL-GAP of the gap sleeve 218 is angularly bisected by a bisecting plane BI-PL and this bisecting plane BI-PL is parallel to, and intersects the pole axis PO-AX. As noted, in the assembled condition of the shelf assembly 210 the she arms 212A is secured to the gap sleeve 218 at the attachment location 226 and the shelf arm 212B is secured to the gap sleeve 218 at the attachment location 228. It is contemplated that the attachment locations 226, 228 may be located on the gap sleeve 218 at locations selected to reinforce, improve, or add a desirable feature of the shelf assembly 210. For example, the locations of the attachment locations 226, 228 may be selected to reinforce the strength and stability of the seating of the first channel engaging protrusion 216 in a respective groove 134 of a post 112. To this end, the locations of the attachment locations 226, 228 may be selected such that a loading of the shelf arms 212A, 212B imposes forces on the gap sleeve 218 that further reinforce the capability of the gap sleeve to maintain the seating of the first channel engaging protrusion 216 in a respective groove 134 of a post 112. This reinforcement of the capability of the gap sleeve to maintain the seating of the first channel engaging protrusion 216 in a respective groove 134 of a post 112 can be achieved, for example, via locating the attachment locations 226, 228 such that each of the shelf arms 212A, 212B, when supporting an object, urges the first angular end 220 and the second angular end 222 of the gap sleeve 218 to move angularly toward one another, whereupon the seating of the first channel engaging protrusion 216 in a respective groove 134 of a post 112 is maintained in a stable manner. As seen in FIG. 7, the angular location along the periphery of the gap sleeve 218 of the respective attachment location 226, 228 at which each respective shelf arm 212A, 212B is secured can be selected to ensure that a loading force on the shelf arm urges the respective first angular end 220 or the second angular end 222 of the gap sleeve 218 to move angularly toward the other angular end of the gap sleeve. This can be accomplished, for example, by arranging each of the attachment locations 226, 228 to be at an angle from the bisecting plane BI-PL that is less than ninety degrees (90°). Thus, each of the attachment locations 226, 228 may be at an angle from the bisecting plane BI-PL in the range of between ten to twenty degrees (10°-20°), in the range of between ten to forty-five degrees (10°-45°), in the range of between ten to seventy degrees (10°-70°), or in the range of between ten to ninety degrees (10°-90°).

Figure 8:
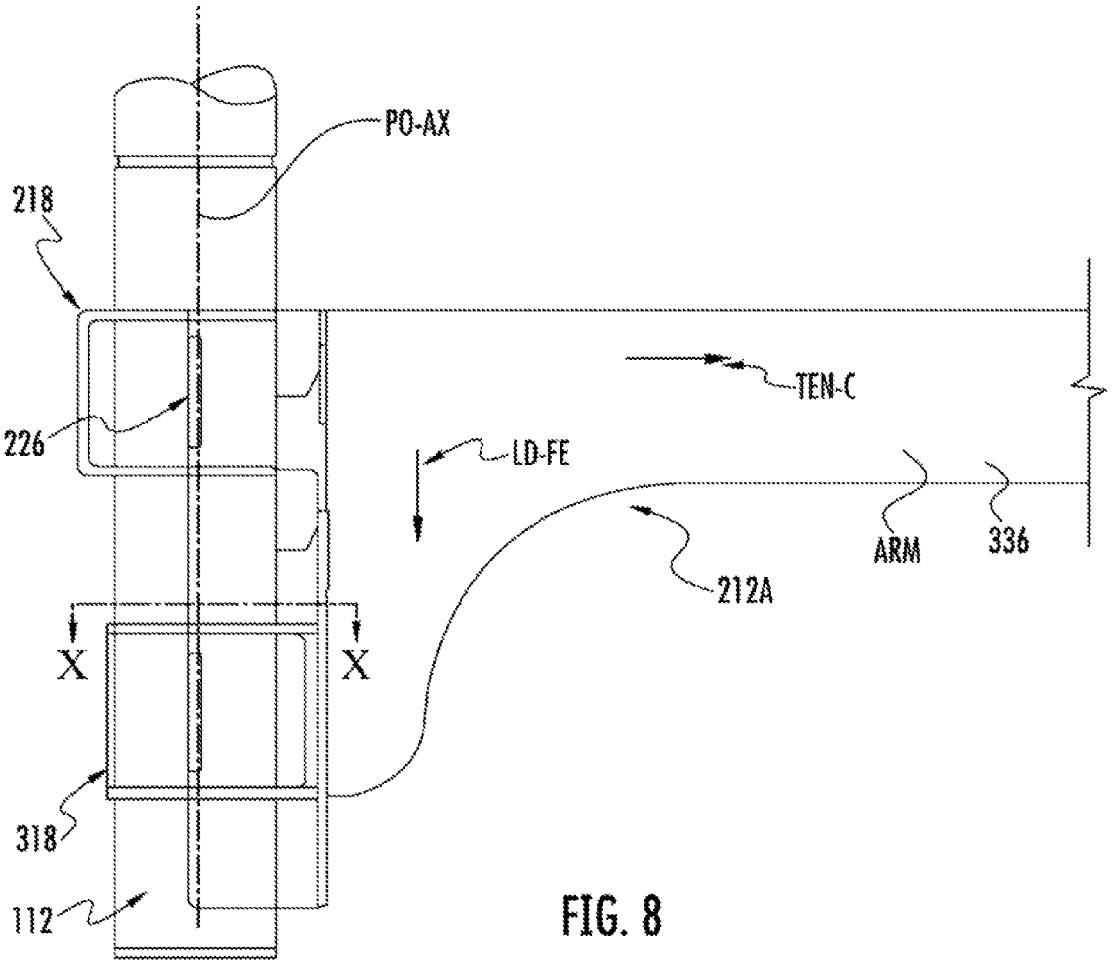
FIG. 8 is an enlarged front elevational view of a support post and one available version of the shelf assembly secured thereon.
Figure 9:
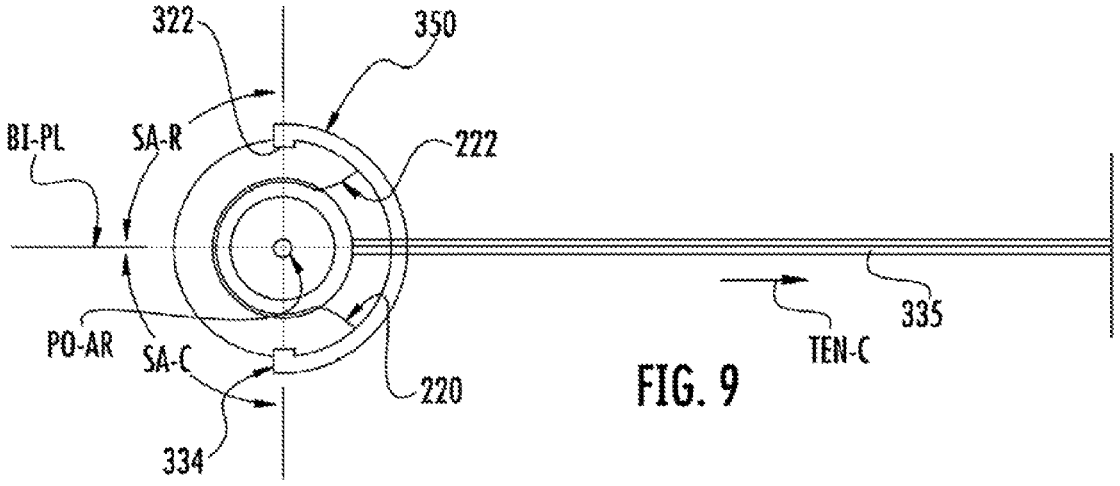
FIG. 9 is a top plan view of the shelf assembly shown in FIG. 8.
Figure 10:
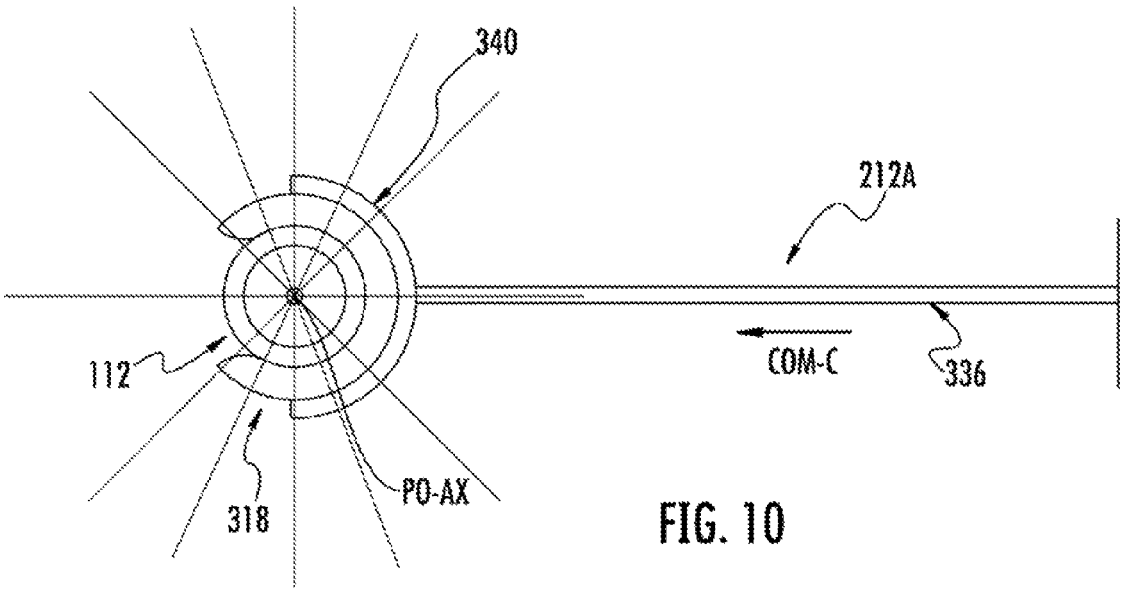
FIG. 10 is a sectional top plan view of the shelf assembly shown in FIG. 8 taken at section line X-X shown in FIG. 8.

Reference is had to FIG. 8, FIG. 9, and FIG. 10 in connection with a description of one available version of the shelf assembly of the present invention. As seen in FIG. 8, which is an enlarged front elevational view of a support post having the one available version of the shelf assembly secured thereon, the shelf assembly 210 includes the gap sleeve 218, the gap sleeve 318, and the shelf arm 212A. The shelf assembly 210 also includes the shelf arm 212B (not shown in FIG. 8, FIG. 9, and FIG. 10) and it is to be understood that the shelf arm 212B is secured to the gap sleeve 218 and the gap sleeve 318 in a manner similar to the manner in which the shelf arm 212A is secured to the gap sleeve 218 and the gap sleeve 318. As seen in FIG. 9, which is a top plan view of the shelf assembly shown in FIG. 8, the shelf arm 212A includes a yoke 330 having a semi-cylindrical body extending between a radially inwardly extending vertical rib 332 and radially inwardly extending vertical rib 334. The shelf arm 212A includes a beam 336 rigidly secured to the yoke 330 at the mid-angular location of the semi-cylindrical body of the yoke and extending radially outwardly therefrom. With reference again to FIG. 3 the shelf arm 212A includes an upper slotted tab 336 and a lower slotted tab 338. Each of the attachment locations 226, 228 is formed as a longitudinal slot on the gap sleeve 218. As seen in FIG. 9, in the installed disposition of the shelf assembly 210, the vertical rib 332 of the yoke 330 is received in the longitudinal slot on the gap sleeve 218 that forms the attachment location 226 and this attachment location 226 is at an angular spacing SA-R from the bisecting plane BI-PL equal to ninety degrees (90°). The vertical rib 334 of the yoke 330 is received in the longitudinal slot on the gap sleeve 218 that forms the attachment location 228 and this attachment location 228 is at an angular spacing SA-L from the bisecting plane BI-PL equal to ninety degrees (90°).

As seen in FIG. 10, which is a sectional top plan view of the shelf assembly shown in FIG. 8 taken at section line X-X shown in FIG. 8, the shelf arm 212A includes a lower yoke 340 that is secured to the gap sleeve 318. It can be seen that the angular gap SL-GAP of the gap sleeve 218 is diametrically oppositely oriented relative to the angular gap SL-GAP of the gap sleeve 318 in the version of the shelf assembly 210 shown in FIG. 8, FIG. 9, and FIG. 10.

As seen in FIG. 8 and FIG. 9, when an object is supported on the shelf arms 212A, 212B. this creates a vertical loading force LD-FE on the shelf arms and a radial component TEN-C of this loading force LD-FE acts on the vertical ribs 332, 334 of the yoke 330 of the gap sleeve 218 to urge these vertical ribs to move in a direction parallel to the bisecting plane BI-PL toward the shelf arms 212A, 212B. In turn, the vertical ribs 332, 334 of the yoke 330 of the gap sleeve 218 exert forces on the attachment locations 226, 228 that urge the angular ends 220, 222 of the gap sleeve angularly toward one another, whereupon the seating of the first channel engaging protrusion 216 in a respective groove 134 of a post 112 is maintained in a stable manner. A radial component COM-C of the loading force LO-FE on the shelf arms 212A, 212B also urges the lower yoke 340 of the gap sleeve 318 to move in a direction parallel to the bisecting plane BI-PL away from the shelf arms 212A, 212B.

Figure 11:
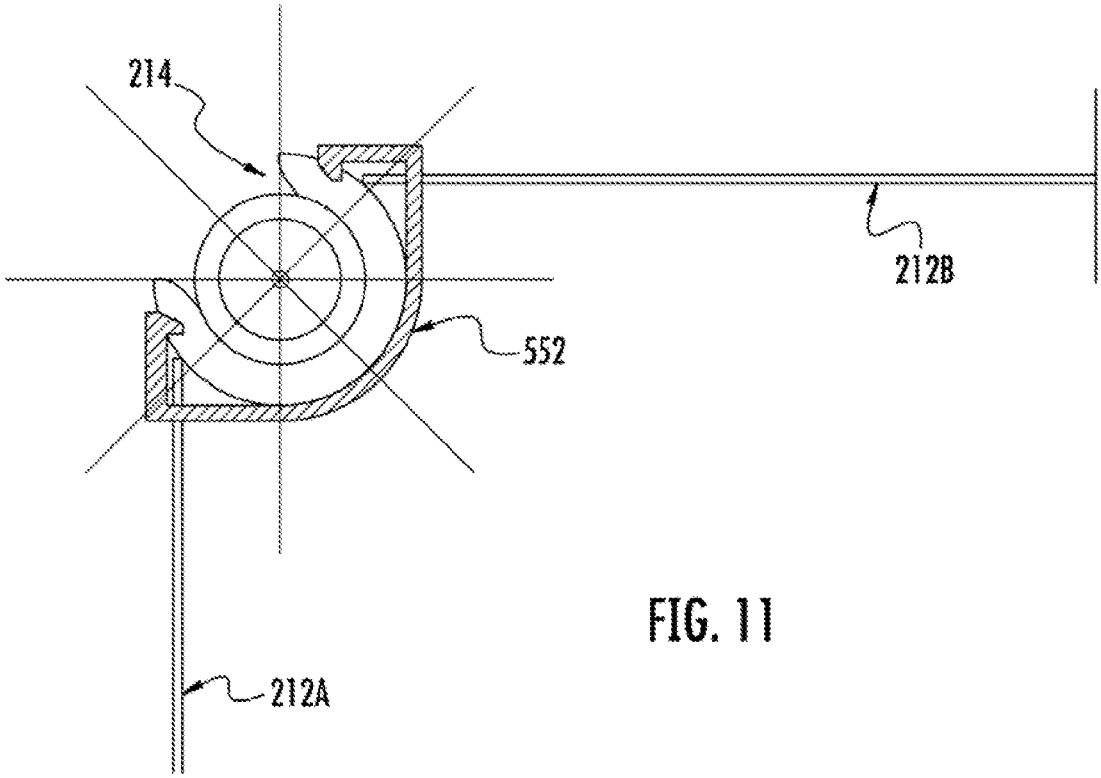
FIG. 11 is a sectional top plan view of a further available version of the shelf assembly of the present invention.

As seen in FIG. 11, which is a perspective view of an additional version of the shelf assembly of the present invention, the shelf assembly can be configured to retain items in a manner that ensures that the items are retained in a confined area while nonetheless allowing convenient access to the confined areas for the purposes of placing items therein or removing items therefrom. To this end, one possible configuration of the shelf assembly includes the deployment of walled retainers configured as a plurality of swing drawers 550.

Figure 12:
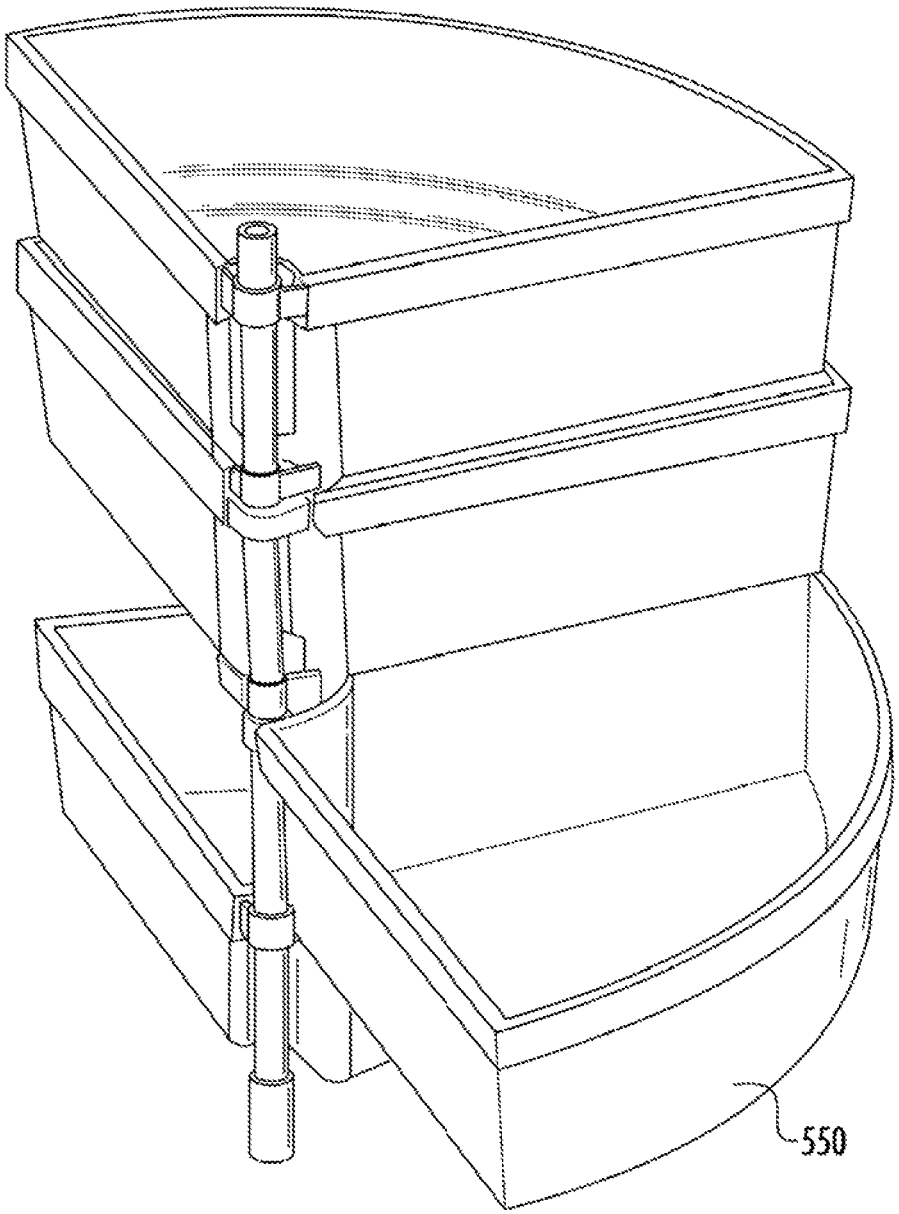
FIG. 12 is a perspective view of an additional version of the shelf assembly of the present invention.

As seen in FIG. 12, which is a sectional top plan view of the swing drawer version of the shelf assembly of the present invention shown in FIG. 11, the shelf arms 212A, 212B can serve as a carry frame for a molded plastic walled retainer in connection with the configuration of the shelf assembly 210 as comprising a plurality of swing drawers. The plastic wailed retainer, when supporting an object imposes a load on the shelf arms 212A, 212B which, in turn, urge the first angular end and the second angular end of the gap sleeve 318 to move angularly toward one another, whereupon the seating of the channel engaging protrusion 316 in a respective groove 134 of a post 112 is maintained in a stable manner. A radial inward force member 552 is provided that is securable to the retaining element for applying a radially inward force on the gap sleeve 318 of the retaining element to urge the angular ends of the channel engaging protrusion of the retaining element to move toward one another and this radial inward force member 552 can be a metal spring clip, for example.

Figure 13:
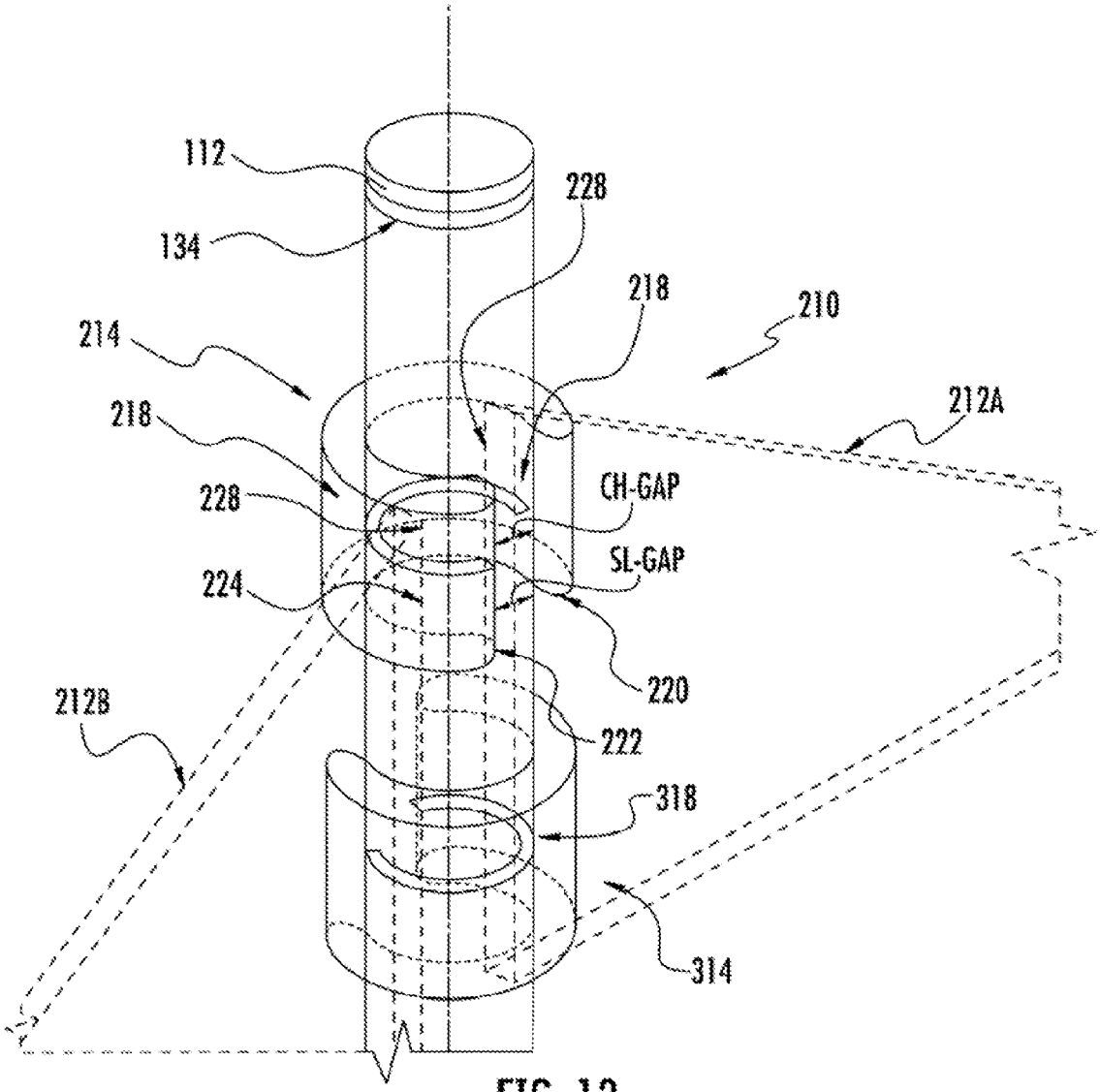
FIG. 13 is an enlarged perspective view of a pair of gap sleeves that movably secure a respective one of the swing drawers to a support post of a rack system.
Figure 14:
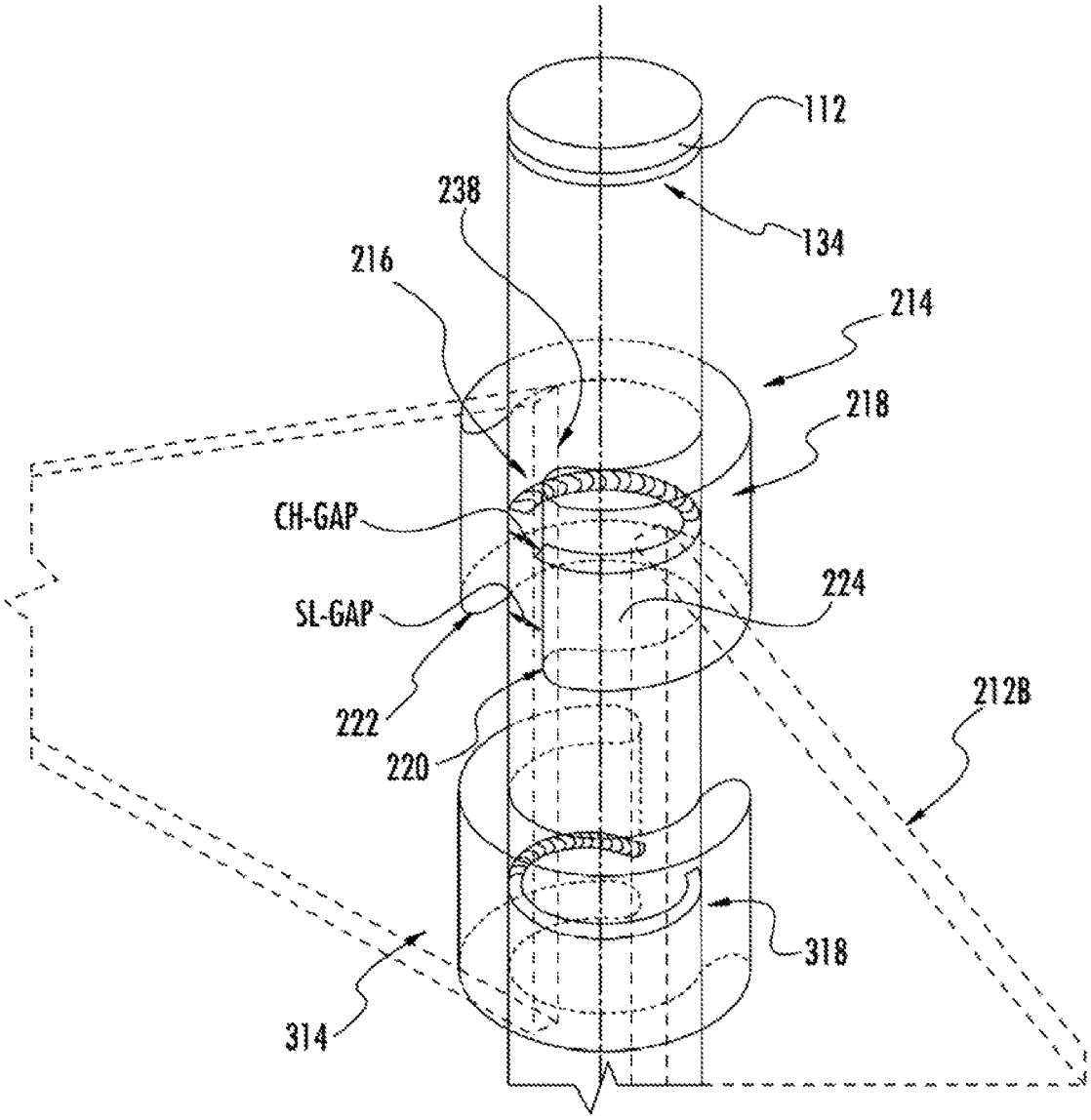
FIG. 14 is an enlarged perspective view of a pair of gap sleeves that movably secure a respective one of the swing drawers to a support post of a rack system.

As seen in FIG. 13 and FIG. 14, each of which is an enlarged perspective view of a pair of gap sleeves that movably secure a respective one of the swing drawers 550 to a support post 112, each of the gap sleeves 218, 318 is configured to rotate about the axis of the support post through a predetermined angular range of rotation. FIG. 13 shows the respective swing drawer 550 at a given instantaneous location during its rotation and FIG. 14 shows the swing drawer at another given instantaneous location during a rotational movement subsequent to the presence of the swing drawer at its given instantaneous location shown in FIG. 13. Each swing drawer 550 can be formed with contiguous walls all connected to a floor, whereupon the swing drawer provides a retention in which items can be retained. Any suitable material and construction can be used to form the swing drawers—for example, each swing drawer can be formed of a polymer or plastic material that is subjected to a thermo-forming process. Each swing drawer 550 is rotatable about a respective support post 112 between a recessed position in which the swing drawer is located between, and within the perimeter projections of, a respective adjacent pair of individual racks 114 and a ready access position in which a portion of the swing drawer or the entire swing drawer has been swung outwardly. Depending upon the drawer storage requirements and the configuration of the swing drawers, the swing drawers 550 are particularly suitable for storing smaller items that would otherwise slip or fall through apertures in the individual racks 114.

Figure 15:
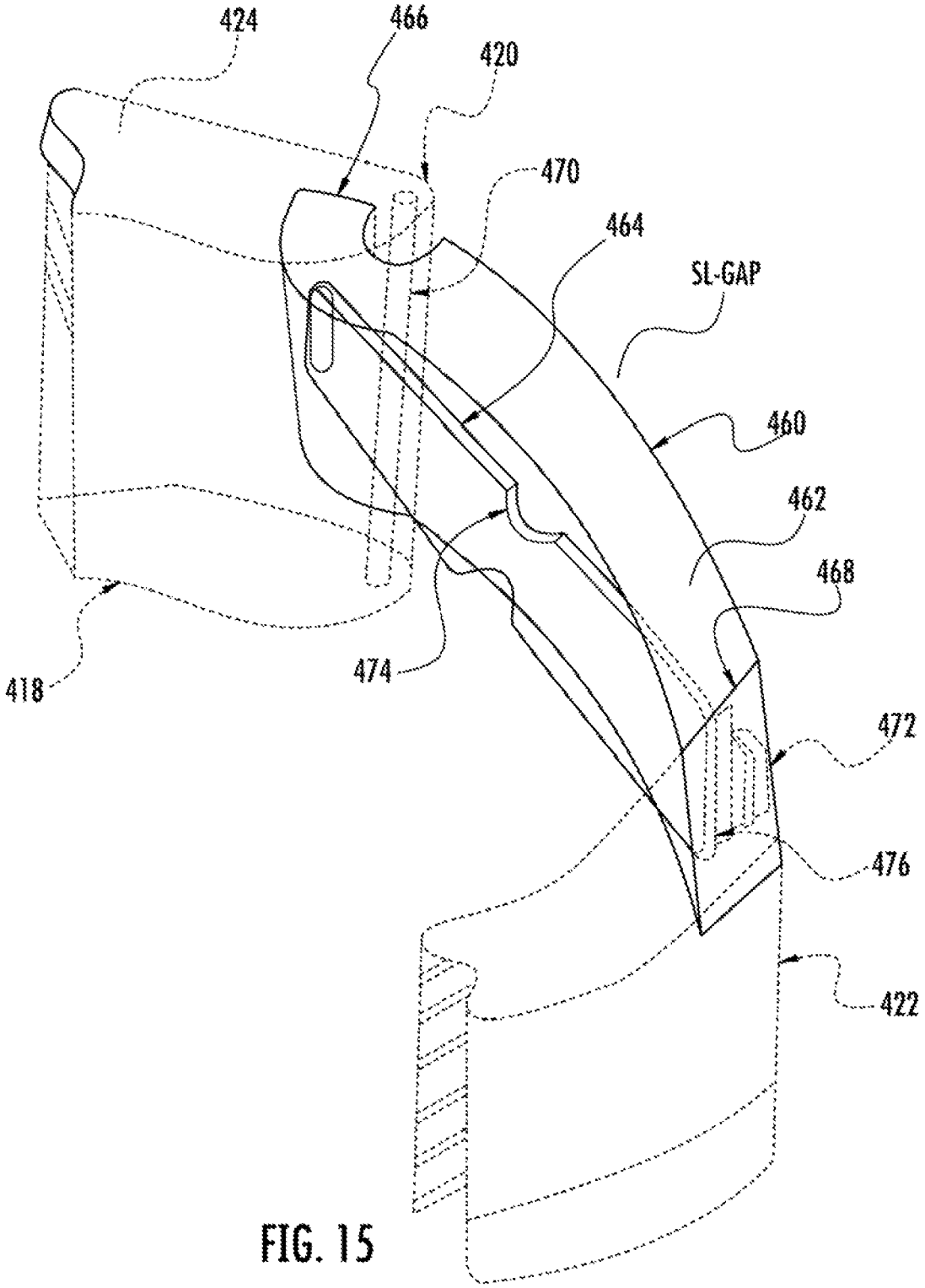
FIG. 15, which is an enlarged perspective view of a portion of an alternative gap sleeve configuration.
Figure 16:
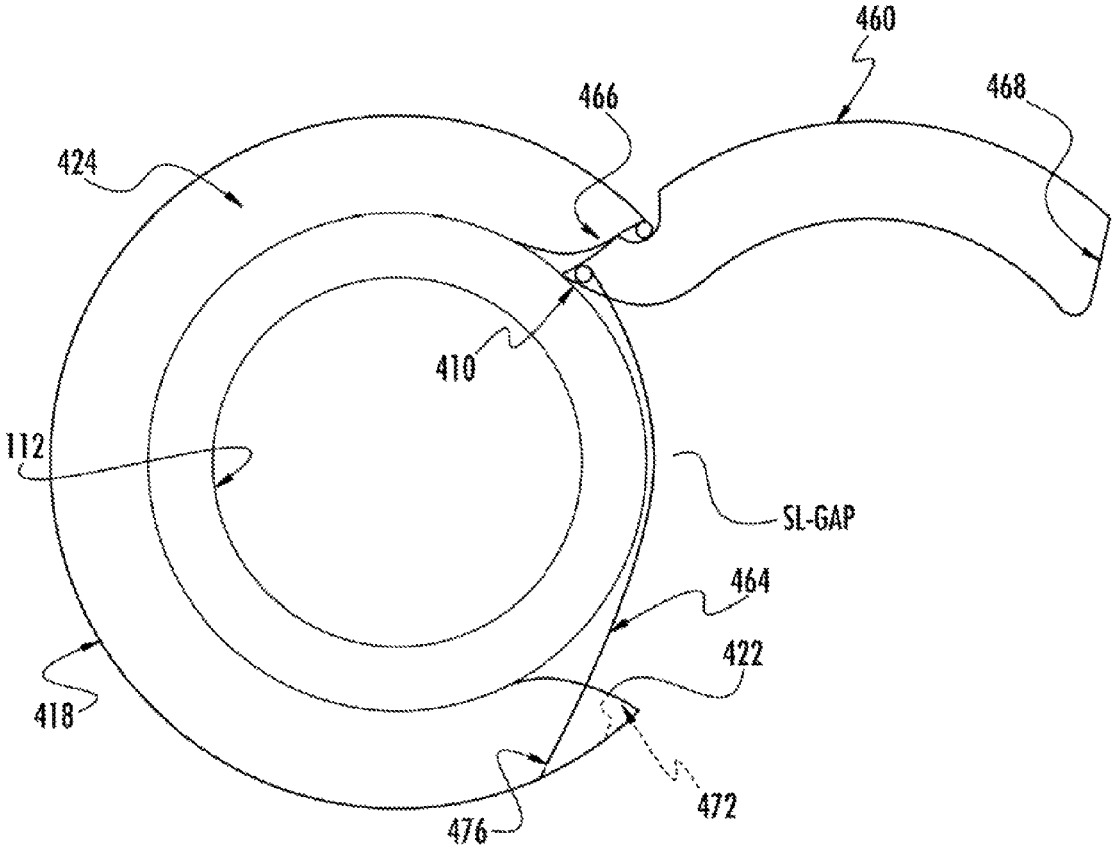
FIG. 16 is a top plan view of the gap sleeve shown in FIG. 5 with its band component in an open disposition.

Reference is now had to FIG. 15, which is an enlarged perspective view of a portion of an alternative gap sleeve configuration. A gap sleeve 418 has a first angular end 420, a second angular end 422, and an angular body portion 424 between the first and second angular ends, whereupon the angular body portion 424 of the gap sleeve 418 delimits a partial circumference angular perimeter and the first and second angular ends 420, 422 of the gap sleeve 418 delimits an angular gap SL-GAP. Only a partial extent of the angular body portion 424 is shown in FIG. 15 for the sake of clarity. An insert element 460 is provided to ensure the stable securement of the gap sleeve 418 on a support post of a she assembly and this insert element 450 includes a band component 462 and a cross tension component 464. The band component 462 has an arcuate overall geometry and has a hook grab end 466 and an opposite end 468. As seen in FIG. 16, which is a top plan view of the gap sleeve shown in FIG. 15 with its band component in an open disposition, the gap sleeve 418 can be inserted in a radial direction onto a support post with the support post passing through the annular gap SL-GAP.

The gap sleeve 418 is operatively connected in an assembled condition of the respective fixed location assembly to a suitable channel engaging protrusion, such as, for example, the first channel engaging protrusion 416, and any manner of connection is suitable to the extent that the gap sleeve 418 and the channel engaging protrusion are so connected that selected forces applied to the gap sleeve 418 enhance the stability and retention strength of the first channel engaging protrusion 416 with respect to a support post 112, as will be described in more detail herein. For example, the gap sleeve 418 and the channel engaging protrusion can be integrally formed as a single unit via any suitable forming process such as, for example, casting, extrusion, molding or stamping, and can be integrally formed of any suitable material such as, for example, a metal, alloy, plastic, or polymer material.

Figure 17:
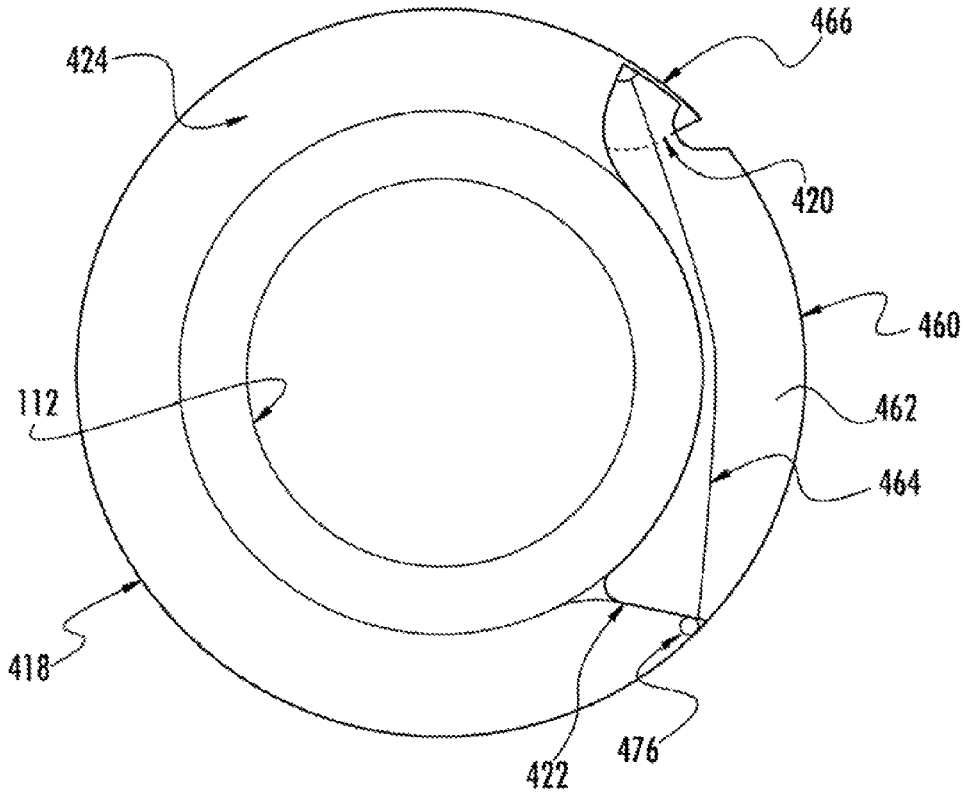
FIG. 17 is a top plan view of the gap sleeve shown in FIG. 15 with its band component in a closed disposition.

As seen in FIG. 17, which is a top plan view of the gap sleeve shown in FIG. 15 with its band component in a closed disposition, once the gap sleeve 418 has been inserted in a radial direction onto a support post, with the support post passing through the annular gap SL-GAP, the band component 462 can be pivoted to a closed disposition and this band component 462 in its closed disposition continuously exerts a force that urges the first and second angular ends 420, 422 of the gap sleeve 418 angularly toward one another, whereupon a stable securement of the gap sleeve 418 on the support post is ensured. The insert element 460 is configured as a separate piece than the gap sleeve 418 and is designed to be installed by a user on the gap sleeve 418 once the gap sleeve 418 has been inserted in a radial direction onto a support post. With reference again to FIG. 15, at the first angular end 420 of the gap sleeve 418, there is a hollow volume delimited by the upper axial surface and the lower axial surface of the first angular end 420 of the gap sleeve 418. A grab rod 470 extends axially and is secured at its top end to the upper axial surface of the first angular end 420 of the gap sleeve 418 and at its bottom end to the lower axial surface of the first angular end 420 of the gap sleeve 418. A catch groove 472 extends axially and is located at the second angular end 422 of the gap sleeve 418.

The cross tension component 464 has a longitudinal extent and is configured to increase in its longitudinal dimension when an elongation force is applied thereto and is biased to return to its non-elongated longitudinal dimension when an elongation force is no longer applied. In this regard, the cross tension component 464 can be configured of a shape memory material such as, for example, a spring steel wire, and/or can be configured with a geometry such as, for example, a curved section 474 that can be drawn into a reduced curvature when an elongation force is applied to the cross tension component 464 and which resiliently returns to its curved geometry when an elongation force is no longer applied. The cross tension component 464 is hingedly connected to the Insert element 460 adjacent the hook grab end 466 thereof and the cross tension component 464 has an opposite end configured with an engagement rod 476 that is compatibly configured with respect to the catch groove 472 located at the second angular end 422 of the gap sleeve 418 so that this engagement rod 476 can be engaged by the catch groove 472 in a manner to be described in more detail herein. The second angular end 422 of the gap sleeve 418 has a radially inner opening in the vicinity of the catch groove 472.

To use the insert element 460 and the cross tension component 464, a user places the insert element 460 into a predetermined initial engagement with the gap. sleeve 418 once the gap sleeve 418 has been inserted in a radial direction onto the support post 112, with the support post passing through the annular gap SL-GAP and this predetermined initial engagement of the insert element $60 with the gap sleeve 418 is illustrated in FIG. 16. Specifically, the user inserts the engagement rod 476 of the cross tension component 464 into the radially inner opening in the vicinity of the catch groove 472 of the second angular end 422 of the gap sleeve 418 and disposes the hook grab end 466 of the crass tension component 464 in engagement with the grab rod 470 of the first angular end 420 of the gap sleeve 418. The user then pivots the band component 462 in a clockwise direction with the grab rod 470 of the first angular end 420 of the gap sleeve 418 acting as a fulcrum about which the hook grab end 466 of the band component 462 pivots. This pivoting of the band component 462 eventually leads to a movement of the engagement rod 476 of the cross tension component 464 into engagement with the catch groove 472 of the second angular end 422 of the gap sleeve 418. As a result, once the band component 462 has been pivoted such that the opposite end 468 of the band component is adjacent the second angular end 422 of the gap sleeve 418 the engagement rod 476 of the cross tension component 464 has moved into engagement with the catch groove 472 of the second angular end 422 of the gap sleeve 418 and, as seen in FIG. 17, the insert element 460 is subjected to an elongation force in its longitudinal direction. As the insert element 460 is resiliently biased to return to its non-elongated longitudinal extent, the insert element 460 continuously urges the first and second angular ends 420, 422 of the gap sleeve 418 angularly toward one another, whereupon a stable securement of the gap sleeve 418 on the support post is ensured. To release the gap sleeve 418 from the support post, the user pivots the band component 462 in a counter-clockwise direction with the grab rod 470 of the first angular end 420 of the gap sleeve 418 acting as a fulcrum about which the hook grab end 466 of the band component 462 pivots, whereupon the engagement rod 476 of the cross tension component 464 moves out of engagement with the catch groove 472 of the second angular end 422 of the gap sleeve 418, and the cross tension component 464 can then be separated from its engagement with the gap sleeve 418. With the cross tension component 464 separated from its engagement with the gap sleeve 418, the user moves the gap sleeve 418 radially outwardly relative to the support post until the gap sleeve 418 is dear of the support post.

Figure 18:
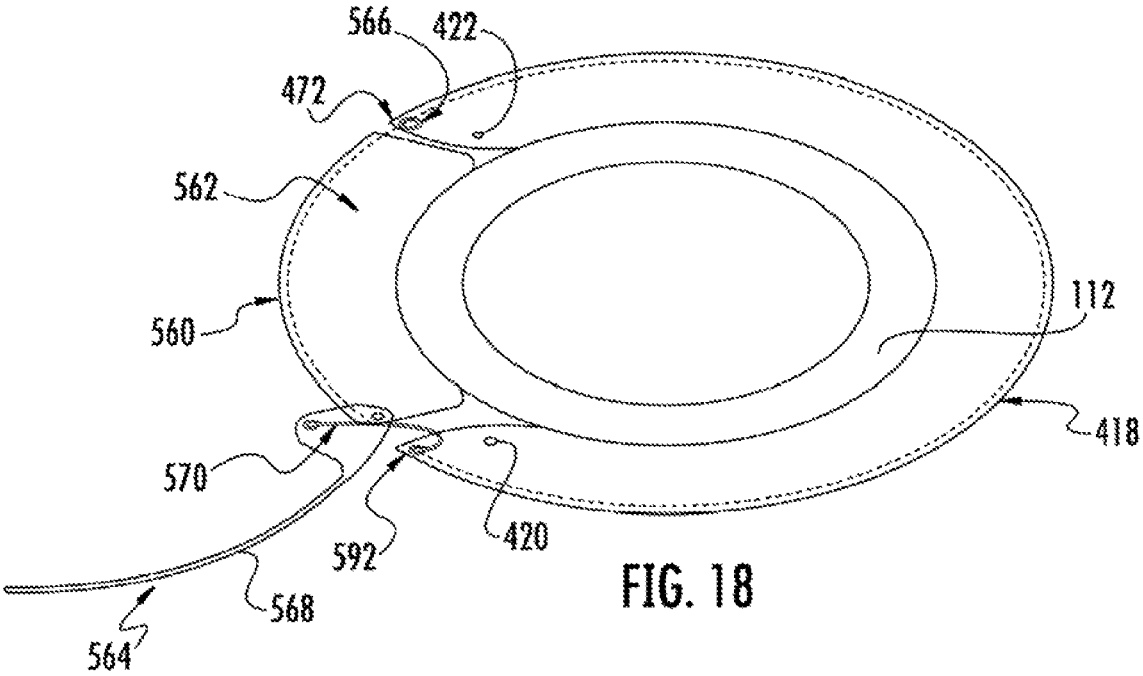
FIG. 18 is a top plan view of this further variation of this gap sleeve configuration with its band component in a non-secured or open disposition.
Figure 19:
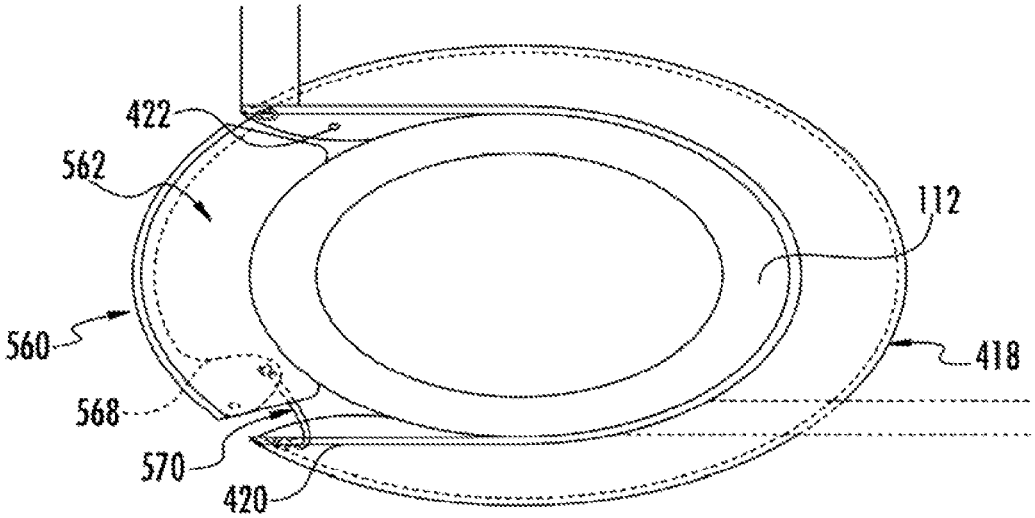
FIG. 19 is a top plan view of the gap sleeve shown in FIG. 18 with its band component in its closed disposition.

Reference is now had to FIGS. 18 and 19 in connection with the description of a further variation of the gap sleeve configuration. As seen in FIG. 18, which is a top plan view of this further variation of this gap sleeve configuration with its band component in a non-secured or open disposition, an insert element 560 is provided to ensure the stable securement of the gap sleeve 418 on a support post of a shelf assembly and this insert element 560 includes a band component 562 and an over-center tension component 564. The band component 562 has an arcuate overall geometry and has a hook grab 566 projecting from one arcuate end of the band component. The over-center tension component 564 Includes a pivot handle 568 that is pivotally mounted to the band component 562 adjacent its other arcuate end and a hook grab 570 pivotally mounted to the pivot handle 568.

To install the insert element 560 a user engages the hook grab end 566 on the catch groove 472 that extends axially and is located at the second angular end 422 of the gap sleeve 418. Thereafter, the band component 562 is disposed such that its curved longitudinal side follows along the arcuate trace of the gap sleeve 418 as the gap sleeve 418 surrounds the post 112. Then, the over-center tension component 564 is maneuvered via pivoting of the pivot handle 568 relative to the band component 562 such that the hook grab 570 pivotally mounted to the pivot handle 568 engages a catch groove 592 that extends axially and is secured to the first angular end 420 of the gap sleeve 418. Thereafter, as seen in FIG. 19 which is a top plan view of the gap sleeve shown in FIG. 18 with its band component in its closed disposition, the pivot handle 568 is pivoted toward the band component 562 to dispose the long extent of the pivot handle along the arcuate trace of the band component 562 and this action subjects the hook grab 570 of the over-center tension component 564 to an elongation force in its longitudinal direction. The over-center tension component 564 thereafter continuously urges the first and second angular ends 420, 422 of the gap sleeve 418 angularly toward one another, whereupon a stable securement of the gap sleeve 418 on the support post 112 is ensured.

The shelf assembly of the present invention can be used in various types of storage arrangements, such as, for example, cabinets or closets. Moreover, the shelf assembly can be used in conjunction with many storage arrangements that do not include a wire grid rack.

The exemplary shapes, dimensions, wire sizes, number of shelves, and materials, described herein are provided by way of example only. Wire grid rack systems fabricated in shapes, dimensions and using different wire sizes and materials and having a different number of shelves other than those discussed and illustrated herein also are contemplated.

Although this invention has been disclosed and described in its preferred forms with a certain degree of particularity, it is to be realized that the optimum dimensional relationships for the parts of the invention, to include variations in size, materials, shape, form, function and manner of operation, assembly and use, are deemed readily apparent and obvious to one skilled in the art. Additionally, it is understood that the present disclosure of the preferred forms is only by way of example and that numerous changes in the details of operation and in the combination and arrangement of parts may be resorted to without departing from the spirit and scope of the invention as hereinafter claimed.

What is claimed is:

1. A fixed location assembly disposable on a support post, the support post having an outer surface and a plurality of channels located at spacings along the outer surface, the fixed location assembly comprising:

a retaining element, the retaining element having a pole axis and including a channel engaging protrusion and a first gap sleeve, the channel engaging protrusion having a radial extent extending perpendicularly to the pole axis and being compatibly configured with respect to a channel of the support post such that the channel engaging protrusion extends radially inward into a respective channel of the support post in an installed disposition of the fixed location assembly in which a support post extends through the gap sleeve, the gap sleeve being connected to the channel engaging protrusion, the channel engaging protrusion having a first angular end, a second angular end, and an angular body portion between the first and second angular ends, whereupon the angular body portion of the channel engaging protrusion delimits a partial circumference angular perimeter and the first and second angular ends of the channel engaging protrusion delimiting an angular gap, the gap sleeve having a first angular end, a second angular end and an angular body portion between the first and second angular ends whereupon the angular body portion of the gap sleeve delimits a partial circumference angular perimeter and the first and second angular ends of the gap sleeve delimit an angular gap, the angular gaps of the channel engaging protrusion and the gap sleeve being at least partially coincident with one another, and an insert element, the insert element having a band component and a cross tension component operatively coupled to the band component, the insert, element being engagable with the gap sleeve and being disposable in an open condition in which the gap sleeve and a support post extending through the gap sleeve can be moved radially relative to one another such that the support post no longer extends through the gap sleeve and disposable in a closed position in which radial movement between the gap sleeve and the support post extending through the gap sleeve is constrained by the insert element such that the support post always extends through the gap sleeve in the closed position, and the cross tension component engaging at least one of the first and second angular ends of the gap sleeve in the closed disposition of the insert element and operating to urge the first and second angular ends of the gap sleeve to move angularly toward one another.

* * * * *